United States Patent [19]

Tuller

[11] 4,377,013

[45] Mar. 22, 1983

[54] ROTATABLE HAIR BRUSH

[76] Inventor: Jay E. Tuller, 6377 Chevy Chase #12-122, Houston, Tex. 77057

[21] Appl. No.: 324,056

[22] Filed: Nov. 23, 1981

[51] Int. Cl.[3] ..... A46B 13/08

[52] U.S. Cl. ..... 15/25; 74/133

[58] Field of Search ..... 15/25, 26; 51/31; 74/88, 130, 133

[56] References Cited

U.S. PATENT DOCUMENTS

| | | | |
|---|---|---|---|
| 713,683 | 11/1902 | Poling | 15/26 |
| 1,007,090 | 10/1911 | Gaynor | 15/26 |
| 1,091,314 | 3/1914 | Erickson | 15/26 |
| 1,212,373 | 1/1917 | Love | 15/26 |
| 1,224,740 | 5/1917 | Green | 15/26 |

*Primary Examiner*—Edward L. Roberts

*Attorney, Agent, or Firm*—William L. Botjer

[57] ABSTRACT

A rotary brush or other rotary implement constructed in accordance with the instant invention includes a first fixed handle means and a second movable handle means hinged to the fixed handle and operable by squeezing. The brush head to be rotated is mounted on an elongated rod which extends through the handle portion. The movable handle carries a rack which engages a pinion gear carried on the rod for rotating the brush. The pinion gear includes internally disposed alternately selectable ratchet portions which upon selection by the user cause the brush head to rotate in a first and only a first direction upon a squeezing of the handle. Upon user adjustment, the brush will rotate in the second and only the second direction upon the squeezing of the handle. The rotation mechanism of the brush is completely enclosed within the handle portion.

6 Claims, 4 Drawing Figures

ROTATABLE HAIR BRUSH

BACKGROUND AND SUMMARY OF THE INVENTION

This invention relates generally to a user activated rotary brush or other implement. The invention is specifically directed to a rotary brush particularly adapted for the styling of hair which rotates in a single direction when manually operated. A number of arrangements for providing a manually operated rotary brush have been known in the art, such as those described in the following patents:

| Patent No. | Inventor | Date |
|---|---|---|
| 713,683 | H. Poling | November 18, 1902 |
| 1,007,090 | J. Gaynor | October 31, 1911 |
| 1,091,314 | C. H. Erickson | March 24, 1914 |
| 1,212,373 | G. H. Love | January 16, 1917 |
| 1,224,740 | J. C. Green | May 1, 1917 |

However, these devices are generally complex and cumbersome to use, especially with regard to the mechanism for rotating the brush in only a single direction even though the handle moves in both directions. In these devices, reversing the rotation of the brush head is both difficult and time consuming for the user, because it may require a rearrangement of parts and access to the internal mechanisms of the brush. The present invention is directed towards overcoming these difficulties.

A rotary brush or other rotary implement constructed in accordance with the instant invention includes a first fixed handle means and a second movable handle means hinged to the fixed handle and operable by squeezing. The brush head to be rotated is mounted on an elongated rod which extends through the handle portion. The movable handle carries a rack which engages a pinion gear carried on the rod for rotating the brush. The pinion gear includes internally disposed alternately selectable ratchet portions which upon selection by the user cause the brush head to rotate in a first and only a first direction upon a squeezing of the handle. Upon user adjustment, the brush will rotate in the second and only the second direction upon the squeezing of the handle. The rotation mechanism of the brush is completely enclosed within the handle portion.

Accordingly, it is an object of this invention to provide an improved unidirectional rotary implement.

It is another object of this invention to provide a rotary implement or brush in which the rotating mechanism may be completely enclosed within the handle.

It is another object of this invention to provide a rotary implement or brush which will rotate in only a single direction upon operation by the user.

It is another object of this invention to provide a rotary implement or brush in which the direction of rotation of the head may be user selectable by external means without the need to disassemble the rotating mechanism.

Still further objects of this invention will become apparent upon a reading of the detailed specification to follow.

BRIEF DESCRIPTION OF THE DRAWINGS

In order to better understand the invention, reference is made to the following drawings taken in conjunction with a detailed description of the preferred embodiments to follow.

DESCRIPTION OF THE PREFERRED EMBODIMENTS

Figure 1:
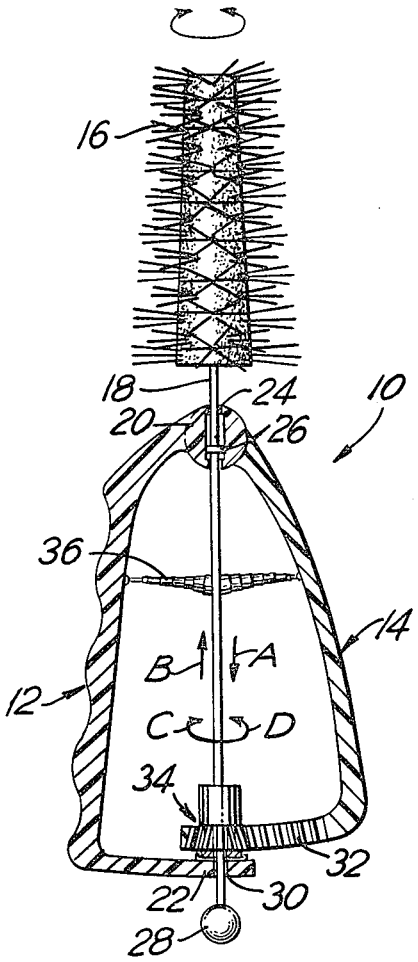
FIG. 1 is a sectional view of a rotary brush constructed in accordance with the instant invention.
Figure 2:
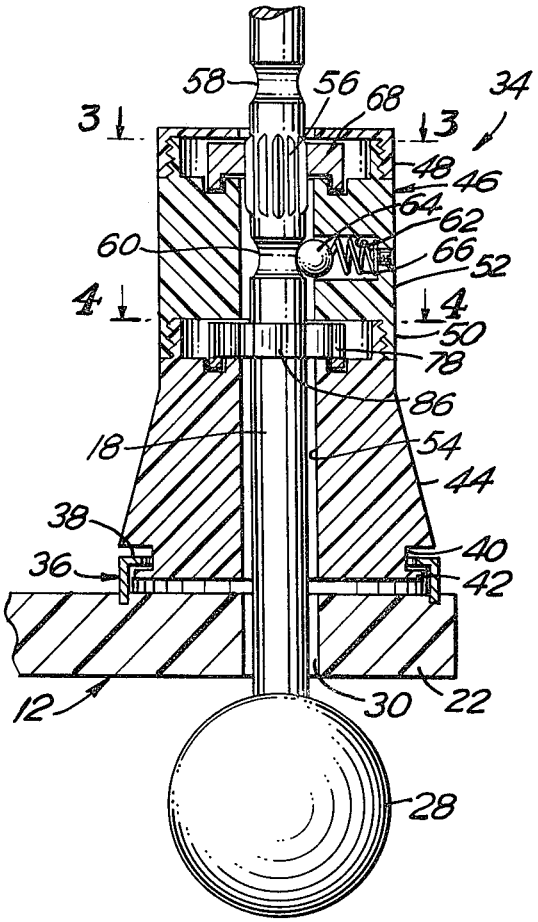
FIG. 2 is an enlarged sectional view of the pinion gear and ratchet arrangement of the invention of FIG. 1.
Figure 4:
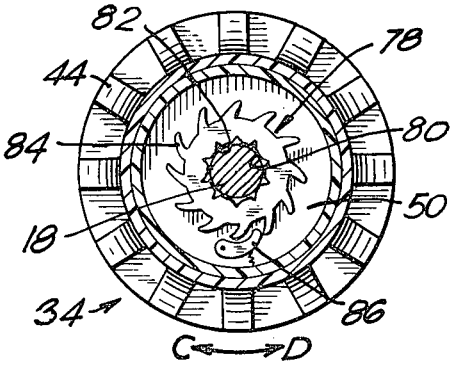
FIG 4. is a sectional view taken along line 4—4 of FIG. 2.
Figure 3:
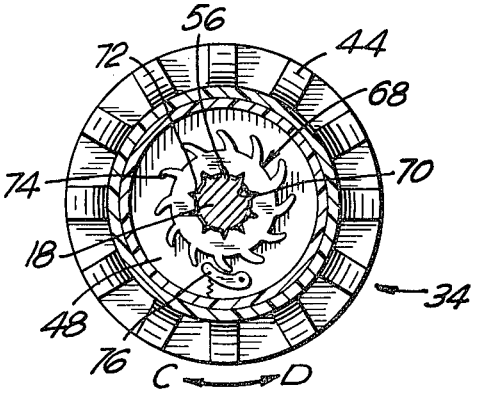
FIG. 3 is a sectional view taken along line 3—3 of FIG. 2.

The drawings illustrate a rotary brush 10 constructed in accordance with the instant invention. The invention is described in the embodiment of a brush; however, this is for exemplary purposes only and the invention may be utilized with regard to rotary implements in general. Brush 10 includes a fixed handle 12, a movable handle 14 and a rotating brush head 16 disposed at the end of a rod 18. Rod 18 is both rotably and slidably mounted to the upper 20 and lower 22 portions of fixed handle 12. Upper portion 20 of fixed handle 12 includes a cylindrical opening 24 through which rod 18 extends. Rod 18 includes a collar 26 which is slidably displaceable within opening 24 and which serves to limit the displacement of rod 18 along its longitudinal axis.

The lower portion of rod 18 extends through an opening 30 in lower portion 22 of fixed handle 12 and includes a knob 28. Pivotally mounted to upper portion 20 of fixed handle 12 is movable handle 14 which has a rack portion 32 at its lower end for engagement with a pinion gear 34, the operation of which will be explained in detail below. A spring 36 in the form of a spiral coil or other suitable form is disposed between fixed handle 12 and movable handle 14 to bias the handles apart.

Pinion gear 34 is rotatably disposed on lower portion 22 of fixed handle 12 which includes an upstanding circular rim 36 having a radially inwardly disposed lip 38. Gear 34 includes a rim 40 having a radially outwardly disposed circular lip 42 which rides under lip 38 and thus permits gear 34 to rotate with respect to handle 12 but prevents any displacement of gear 34 along its longitudinal axis. Gear 34 includes a toothed beveled portion 44 and a ratchet portion 46 which is divided into a first portion 48, a second portion 50 and an intermediate portion 52. Extending through gear 34 is a cylindrical opening 54 which permits rod 18 both to rotate within and slide therethrough.

The portion of rod 18 disposed within gear 34 includes a radially extending splined section 56, a first indentation 58 and a second indentation 60. Intermediate portion 52 of gear 34 includes a channel 62 in which a ball 64 and a coil spring 66 are disposed. Ball 64 and indentations 58, 60 are arranged so that when rod 18 is displaced in direction B, ball 64 will be in engagement with indentation 60, splined portion 56 will be located within the portion 48 of gear 34. When rod 18 is displaced downwardly in direction A, ball 64 will then be moved into engagement with indentation 58 and splined portion 56 will be positioned at portion 50 of the gear 34.

The first portion 48 of gear 34 includes a rotatable ratchet wheel 68 having a central opening 70 through which rod 18 passes. Surrounding central opening 70 in ratchet wheel 68 are a series of inwardly disposed teeth 72 for engagement with splined portion 56 of rod 18.

When the splined portion 56 of rod 18 is in engagement with teeth 72 of ratchet wheel 68, it will rotate with rod 18. When the non-splined portion of rod 18 is within opening 70, ratchet wheel 68 and rod 18 are disengaged from each other. Ratchet wheel 68 includes outwardly disposed teeth 74 which are engaged by a pawl 76 which is hinged to portion 48 of gear 34. Teeth 74 of ratchet wheel 68 are disposed so that pawl 76 will engage same as gear 34 is rotated in direction D so that ratchet wheel 68 will rotate rod 18 and brush 16 in direction D. When gear 34 is rotated in direction C, pawl 76 will ride over teeth 74 and thus ratchet wheel 68 will be free to rotate with respect to and be unlocked from gear 34.

The second portion 50 of gear 34 also includes a ratchet and pawl arrangement. Portion 50 includes a ratchet wheel 78 having an opening 80 and inwardly disposed teeth 82 for engagement with splined portion 56 of rod 18. Ratchet wheel 78 includes outwardly disposed teeth 84 for engagement with a pawl 86 which is hinged to gear 34. Teeth 84 and pawl 86 are disposed so that ratchet wheel 84 will be locked to gear 34 when gear 34 is rotated in direction C. Conversely when gear 34 is rotated in direction D, ratchet wheel 84 will be free to rotate and thus will not be locked to gear 34. As will be discussed in detail below, the oppositely disposed alternately selectable ratchet and pawl arrangement of gear 34 permits the user to select the direction of rotation of brush head 16 as handle 14 is operated by the user.

As is well known, the styling of hair may require the rotation of the brush in either direction depending on the style required. The present invention permits the brush head to rotate in a single direction and a single direction only when handle 14 is operated. By a simple adjustment of knob 28, brush 10 may be adjusted so that it rotates in the opposite direction when handle 14 is squeezed. As is seen in the drawings, splined portion 56 of rod 18 will either be in engagement with portion 48 or portion 50 of gear 34, but not both. When splined portion 56 is in engagement with portion 48, gear 34 will be locked to rod 18 when gear 34 is rotated in direction D by rack 32 of handle 14 and thus brush 10 will rotate in direction D only. When rack 32 moves in the opposite direction (direction C) ratchet wheel 68 will be free to rotate and thus gear 34 will be free to rotate about rod 18 so that no movement is transmitted to rod 18.

Similarly, when splined portion 56 is at portion 50, gear 34 will be locked for rotation to rod 18 when gear 34 is turned in direction C by rack 32 and thus will cause rod 18 and brush 16 to rotate in direction C. When rack 32 moves in the opposite direction (direction D), ratchet wheel 78 will be free to rotate and thus gear 34 will rotate on shaft 18 so that no motion will be transmitted to rod 18 and brush head 16. By simply grasping knob 28 and sliding it downwardly in direction A, portion 50 of gear 34 will be engaged and if slid upwardly in direction B, portion 48 of gear 34 will be engaged with the results described above. The engagement of ball 64 with indentations 58, 60 will keep the position set until knob 28 is again adjusted. Accordingly, once the desired direction of rotation is set by the user, the user only need squeeze the handle 14, brush head 16 will then rotate in only the direction selected.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A rotary implement comprising:

first handle means;

a rod having first and second ends, said rod being rotatably and slidably mounted to said handle means, said rod being slidably displaceable between first and second positions;

an implement head mounted to said first end of said rod means;

a second movable handle means pivotally mounted to said first handle means;

rack means disposed on said second handle means;

a pinion gear rotatably mounted about said second end of said rod means for rotation by said rack means;

at least a portion of said pinion gear having external toothing for engagement with said rack means for rotation therewith;

said pinion gear including first and second oppositely disposed ratchet means, said first ratchet means locking said gear to said rod when said gear is rotated in a first direction, said first ratchet means disengaging said gear from said rod when said gear is rotated in a second direction, said second ratchet means locking said gear to said rod when said gear is rotated in a second direction, said second ratchet means disengaging said gear from said rod when said gear is rotated in said first direction;

means disposed internally within said gear for the alternate engagement of one of said first and said second ratchet means, said means including splines disposed on said rod and teeth disposed on said first and second ratchet means, said splines engaging said first ratchet means when said rod is in said first position, said splines engaging said second ratchet means when said rod means is in said second position to thereby permit the rotation of said head upon the operation of said moveable handle dependent upon whether said first or said second ratchet means is engaged.

2. The implement as claimed in claim 1 further including means for releasably locking said rod in said first and said second positions.

3. The implement as claimed in claim 2 wherein said locking means include first and second indentations in said rod corresponding to said first and second positions of said rod and means for engaging said indentations disposed in said gear.

4. The implement as claimed in claim 1 wherein said rod extends through said fixed and said movable handle means and knob means mounted to said rod to facilitate the sliding of said rod by the user.

5. The implement as claimed in claim 1 further including means for biasing said fixed and said moveable handles apart.

6. The implement as claimed in claim 1 wherein said implement head is a brush head.

* * * * *